US006412580B1

(12) United States Patent
Chaves

(10) Patent No.: US 6,412,580 B1
(45) Date of Patent: Jul. 2, 2002

(54) SUPERABRASIVE CUTTER WITH ARCUATE TABLE-TO-SUBSTRATE INTERFACES

(75) Inventor: Arthur A. Chaves, Sandy, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/104,620

(22) Filed: Jun. 25, 1998

(51) Int. Cl.[7] ..... E21B 10/46

(52) U.S. Cl. ..... 175/432

(58) Field of Search ..... 175/432

(56) References Cited

U.S. PATENT DOCUMENTS

| | | | | |
|---|---|---|---|---|
| 4,109,737 A | | 8/1978 | Bovenkerk | |
| RE32,036 E | | 11/1985 | Dennis | |
| 4,558,753 A | | 12/1985 | Barr | |
| 4,593,777 A | | 6/1986 | Barr | |
| 4,660,659 A | | 4/1987 | Short, Jr. et al. | |
| 4,679,639 A | | 7/1987 | Barr et al. | |
| 4,858,707 A | | 8/1989 | Jones et al. | |
| 4,987,800 A | | 1/1991 | Gasan et al. | |
| 4,997,049 A | * | 3/1991 | Tank et al. | 175/411 |
| 5,016,718 A | | 5/1991 | Tandberg | |
| 5,120,327 A | | 6/1992 | Dennis | |
| 5,351,772 A | | 10/1994 | Smith | |
| 5,355,969 A | | 10/1994 | Hardy et al. | |
| 5,379,854 A | * | 1/1995 | Dennis | 175/434 |
| 5,435,403 A | | 7/1995 | Tibbitts | |
| 5,437,343 A | | 8/1995 | Cooley et al. | |
| 5,460,233 A | | 10/1995 | Meany et al. | |
| 5,472,376 A | | 12/1995 | Olmstead et al. | |
| 5,484,330 A | | 1/1996 | Flood et al. | |
| 5,486,137 A | | 1/1996 | Flood et al. | |
| 5,494,477 A | | 2/1996 | Flood et al. | |
| 5,499,688 A | | 3/1996 | Dennis | |
| 5,544,713 A | | 8/1996 | Dennis | |
| 5,590,728 A | | 1/1997 | Matthias et al. | |
| 5,590,729 A | | 1/1997 | Cooley et al. | |
| 5,605,199 A | | 2/1997 | Newton | |
| 5,617,928 A | | 4/1997 | Matthias et al. | 175/432 |
| 5,647,449 A | | 7/1997 | Dennis | |
| 5,649,604 A | | 7/1997 | Fuller et al. | |
| 5,706,906 A | | 1/1998 | Jurewicz et al. | |
| 5,709,279 A | | 1/1998 | Dennis | |
| 5,711,702 A | | 1/1998 | Devlin | |
| 5,823,277 A | | 10/1998 | Delwiche et al. | |
| 5,862,873 A | * | 1/1999 | Matthias et al. | 175/432 |
| 5,871,060 A | * | 2/1999 | Jensen et al. | 175/420.2 |
| 5,887,580 A | | 3/1999 | Eyre | |
| 5,890,552 A | * | 4/1999 | Scott et al. | 175/426 |
| 5,906,246 A | * | 5/1999 | Mensa-Wilmot et al. | 175/432 |
| 5,971,087 A | | 10/1999 | Chaves | |
| 6,026,919 A | | 2/2000 | Thigpen et al. | |
| 6,041,875 A | | 3/2000 | Rai et al. | 175/432 |

FOREIGN PATENT DOCUMENTS

| | | |
|---|---|---|
| GB | 2 300 208 A | 10/1996 |
| GB | 2 316 698 A | 4/1998 |

OTHER PUBLICATIONS

Search Report dated Aug. 8, 2001, from Belgian Patent Application No. 09900428.
Search Report dated Oct. 19, 1999.

* cited by examiner

*Primary Examiner*—Hoang Dang
(74) *Attorney, Agent, or Firm*—TraskBritt

(57) ABSTRACT

A cutter for drilling subterranean formations including a superabrasive table formed on an end face of a supporting substrate, there being an interface between the table and the end face defined by at least one annular surface centered about the centerline of the cutter in a location adjacent the side periphery of the substrate, the annular surface having an arcuate topography of an orientation and radial width sufficient to accommodate resultant loading of the cutting edge of the cutter throughout a variety of angles with vectors normal to the surface at a variety of angles such that at least one normal vector is aligned substantially parallel to the resultant loading on the cutting edge.

64 Claims, 5 Drawing Sheets

SUPERABRASIVE CUTTER WITH ARCUATE TABLE-TO-SUBSTRATE INTERFACES

BACKGROUND OF THE INVENTION

1. Field of the Invention

The present invention relates generally to rotary bits for drilling subterranean formations and, more specifically, to superabrasive cutters suitable for use on such bits, particularly of the so-called fixed cutter or "drag" bit variety.

2. State of the Art

Fixed-cutter, or drag, bits have been employed in subterranean drilling for many decades, and various sizes, shapes and patterns of natural and synthetic diamonds have been used on drag bit crowns as cutting elements. Polycrystalline diamond compact (PDC) cutters comprised of a diamond table formed under ultra-high temperature, ultra-high pressure conditions onto a substrate, typically of cemented tungsten carbide (WC), were introduced into the market about twenty-five years ago. PDC cutters, with their diamond tables providing a relatively large, two-dimensional cutting face (usually of circular, semi-circular or tombstone shape, although other configurations are known), have provided drag bit designers with a wide variety of potential cutter deployments and orientations, crown configurations, nozzle placements and other design alternatives not previously possible with the smaller natural diamond and polyhedral, unbacked synthetic diamonds previously employed in drag bits. The PDC cutters have, with various bit designs, achieved outstanding advances in drilling efficiency and rate of penetration (ROP) when employed in soft to medium hardness formations, and the larger cutting face dimensions and attendant greater extension or "exposure" above the bit crown have afforded the opportunity for greatly improved bit hydraulics for cutter lubrication and cooling and formation debris removal. The same type and magnitude of advances in drag bit design in terms of cutter robustness and longevity, particularly for drilling rock of medium to high compressive strength, have, unfortunately, not been realized to a desired degree.

State of the art substrate-supported PDC cutters have demonstrated a notable susceptibility to spalling and fracture of the PDC diamond layer or table when subjected to the severe downhole environment attendant to drilling rock formations of moderate to high compressive strength, on the order of nine to twelve kpsi and above, unconfined. Engagement of such formations by the PDC cutters occurs under high weight on bit (WOB) required to drill such formations and high impact loads from torque oscillations. These conditions are aggravated by the periodic high loading and unloading of the cutting elements as the bit impacts against the unforgiving surface of the formation due to drill string flex, bounce and oscillation, bit whirl and wobble, and varying WOB. High compressive strength rock, or softer formations containing stringers of a different, higher compressive strength, thus may produce severe damage to, if not catastrophic failure of, the PDC diamond tables. Furthermore, bits are subjected to severe vibration and shock loads induced by movement during drilling between rock of different compressive strengths, for example, when the bit abruptly encounters a moderately hard strata after drilling through soft rock.

Severe damage to even a single cutter on a PDC cutter-laden bit crown can drastically reduce efficiency of the bit. If there is more than one cutter at the radial location of a failed cutter, failure of one may soon cause the others to be overstressed and to fail in a "domino" effect. As even relatively minor damage may quickly accelerate the degradation of the PDC cutters, many drilling operators lack confidence in PDC cutter drag bits for hard and stringer-laden formations.

It has been recognized in the art that the sharp, typically 90° edge of an unworn, conventional PDC cutter element is usually susceptible to damage during its initial engagement with a hard formation, particularly if that engagement includes even a relatively minor impact. It has also been recognized that pre-beveling or pre-chamfering of the PDC diamond table cutting edge provides some degree of protection against cutter damage during initial engagement with the formation, the PDC cutters being demonstrably less susceptible to damage after a wear flat has begun to form on the diamond table and substrate.

U.S. Pat. Nos. Re 32,036, 4,109,737, 4,987,800, and 5,016,718 disclose and illustrate bevelled or chamfered PDC cutting elements as well as alternative modifications such as rounded (radiused) edges and perforated edges which fracture into a chamfer-like configuration. U.S. Pat. No. 5,437,343, assigned to the assignee of the present application and incorporated herein by this reference, discloses and illustrates a multiple-chamfer PDC diamond table edge configuration which, under some conditions, exhibits even greater resistance to impact-induced cutter damage. U.S. Pat. No. 5,706,906, assigned to the assignee of the present application and incorporated herein by this reference, discloses and illustrates PDC cutters employing a relatively thick diamond table and a very large chamfer, or so-called "rake land", at the diamond table periphery.

However, even with the PDC cutting element edge configuration modifications employed in the art, cutter damage remains an all-too-frequent occurrence when drilling formations of moderate to high compressive strengths and stringer-laden formations.

Another approach to enhancing the robustness of PDC cutters has been the use of variously-configured boundaries or "interfaces" between the diamond table and the supporting substrate. Some of these interface configurations are intended to enhance the bond between the diamond table and the substrate, while others are intended to modify the types, concentrations and locations of stresses (compressive, tensile) resident in the diamond tables and substrates after the cutter is formed in an ultra-high pressure, ultra-high temperature process, as is known in the art. Still other interface configurations are dictated by other objectives, such as particularly desired cutting face topographies. Additional interface configurations are employed in so-called cutter "inserts" used on the rotatable cones of rock bits. Examples of a variety of interface configurations may be found, by way of example only, in U.S. Pat. Nos. 4,109,737, 4,858,707, 5,351,772, 5,460,233, 5,484,330, 5,486,137, 5,494,477, 5,499,688, 5,544,713, 5,605,199, 5,657,449, 5,706,906 and 5,711,702.

While cutting faces have been designed with features to accommodate and direct forces imposed on PDC cutters, see, for example, above-referenced U.S. Pat. No. 5,706,906, state-of-the-art PDC cutters have, to date, failed to adequately accommodate such forces at the diamond table-to-substrate interface, resulting in a susceptibility to spalling and fracture in that area. While the magnitude and direction of such forces might, at first impression, seem to be predictable and easily accommodated, based upon cutter back rake and WOB, such is not the case, due to the variables encountered during a drilling operation, previously noted herein. Therefore, it would be desirable to provide a PDC cutter having a diamond table/substrate end face interface able to accommodate the wide swings in both magnitude and direction of forces encountered by PDC cutters during actual drilling operations, particularly in drilling formations of medium-to-high compressive strength rock, or containing stringers of such rock, while at the same time providing a superior mechanical connection between the diamond and substrate and sufficient diamond volume across the cutting face for drilling an extended borehole interval.

BRIEF SUMMARY OF THE INVENTION

The present invention addresses the requirements stated above, and includes PDC cutters having an enhanced diamond table-to-substrate interface, as well as drill bits so equipped.

The cutters of the present invention, while having demonstrated utility in the context of PDC cutters, encompass any cutters employing superabrasive material of other types, such as thermally stable PDC material and cubic boron nitride compacts. The inventive cutters may be said to comprise, in broad terms, cutters having a superabrasive table formed on and mounted to a supporting substrate. Again, while a cemented WC substrate may be usually employed, substrates employing other materials in addition to, or in lieu of, WC may be employed in the invention.

The inventive cutter comprises a table comprising a volume of superabrasive material and exhibiting a two-dimensional, circular cutting face mounted to an end face of a cylindrical substrate. An interface between the end face of the substrate and the volume of superabrasive material includes at least one annular surface of substrate material which is defined, in cross-section taken across and parallel to the longitudinal axis of the cutter, by an arc. The annular surface is preferably a spherical, or spheroidal, surface of revolution about the longitudinal axis of the cutter, or a portion of a toroid transverse to and centered on the longitudinal axis. If a spherical surface of revolution is employed, the center point thereof lies coincident with the longitudinal axis or centerline of the cutter. The surface of revolution may or may not extend at its outer periphery to the side of the substrate and is bounded at its inner periphery by another surface of revolution. The center of the substrate end face lying within the annular surface of revolution may exhibit a variety of topographic configurations. The superabrasive table formed over the substrate end face conforms thereto along the interface, while the exterior surface of the table may be provided with features such as chamfers as are conventional and known in the art.

The annular surface of the substrate end face, by virtue of its arcuate cross-sectional configuration, provides an interface designed to address multi-directional resultant loading of the cutting edge at the periphery of the cutting face of the superabrasive table. In general, resultant loads at the cutting edge are directed at an angle with respect to the longitudinal axis or centerline of the cutter which varies between about 20° and about 70°. The arcuate surface is designed so that a normal vector to the substrate material will lie parallel to, and opposing, the force vector loading the cutting edge of the cutter. Stated another way, since the angle of cutting edge loading varies widely, the arcuate surface presents a range of normal vectors to the resultant force vector loading the cutting edge so that at least one of the normal vectors will, at any given time and under any anticipated resultant loading angle, be parallel and in opposition to the loading. Thus, at the area of greatest stress experienced at the interface, the superabrasive material and adjacent substrate material will be in compression, and the interface surface will lie substantially transverse to the force vector, beneficially dispersing the associated stresses and avoiding any shear stresses.

DETAILED DESCRIPTION OF THE INVENTION

Figure 1:
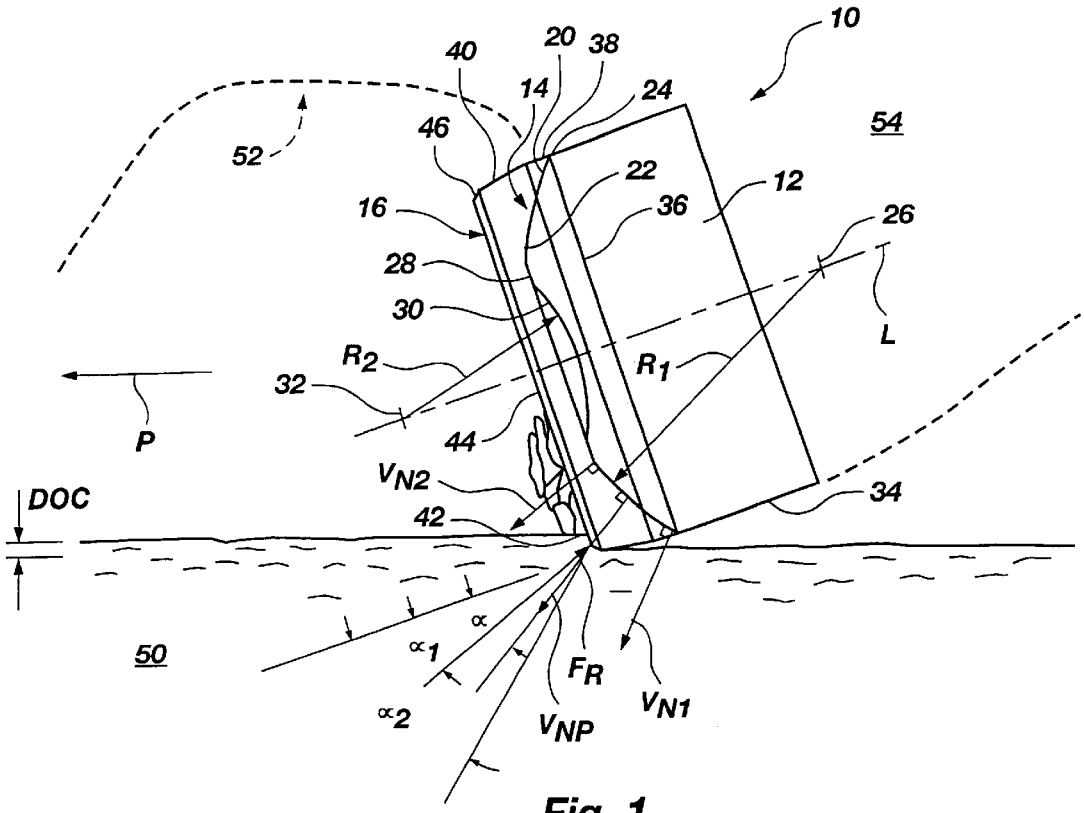
FIG. 1 is a side elevation of a first embodiment of a superabrasive cutter according to the present invention.

Referring to FIG. 1 of the drawings, a first embodiment 10 of the inventive cutter will be described. Cutter 10 includes a substrate 12 having an end face 14 on which a superabrasive table, such as a polycrystalline diamond compact (PDC) table 16, is formed. Substrate 12 is shown in side elevation with table 16 thereon shown as transparent (rather than in cross-section, with hatching) for clarity in explaining the structure and advantages of the invention in detail, although those of ordinary skill in the art will appreciate that the superabrasive material, such as a PDC, is opaque.

Substrate 12 is substantially cylindrical in shape, of a constant radius about centerline or longitudinal axis L. End face 14 of substrate 12 includes annular surface 20 comprising a spherical surface of revolution of radius $R_1$ having an inner circular periphery 22 and an outer circular periphery 24, the center point of the sphere being located at 26, coincident with centerline or longitudinal axis L. The inner periphery 22 abuts a flat annular surface 28 extending transverse to centerline or longitudinal axis L, while the concave center 30 of substrate end face 14 comprises another spherical surface of revolution of radius $R_2$ about center point 32, again coincident with centerline or longitudinal axis L. Superabrasive table 16 overlies end face 14 and is contiguous therewith, extending to side wall 34 of substrate 12 and defining a linear exterior boundary 36 therewith. Cylindrical side wall 38 of table 16, of the same radius as substrate 12, lies above boundary 36 and extends to inwardly-tapering frustoconical side wall 40, which terminates at cutting edge 42 at the periphery of cutting face 44. As shown, cutting edge 42 is chamfered at 46 as known in the art, although this is not a requirement of the invention. Typically, however, a nominal 0.010 inch (about 0.25 mm) depth, 45° angle chamfer may be employed. Larger or smaller chamfers may also have utility, depending upon the relative hardness of the formation or formations to be drilled and the need to employ chamfer surfaces of a given cutter or cutters to enhance bit stability as well as cut the formation. Cutter 10 is shown in FIG. 1 oriented with respect to a formation 50, as it would be conventionally oriented on the face 52 of bit 54 (both shown in broken lines for clarity)

during drilling, with cutting face 44 oriented generally transverse to the direction of cutter travel as the bit rotates and the cutter traverses a shallow, helical path as the bit drills ahead into the formation. Also as is conventional, cutter 10 is oriented so that the cutting face 44 exhibits a negative back rake toward formation 50, leaning backward with respect to the direction of cutter travel from a line perpendicular to the path P of cutter travel through the formation 50.

As cutter 10 travels ahead and engages the formation to a depth of cut (DOC) dependent upon WOB and formation characteristics, cutter 10 is loaded at cutting edge 42 by a resultant force $F_R$, which is dependent upon WOB and torque applied to the drill bit, the latter being a function of bit rotational speed, DOC and formation hardness. As previously mentioned, instantaneous WOB, rotational speed and DOC may fluctuate widely, resulting not only in substantial changes in magnitude of $F_R$, but also in the angle $\alpha$ thereof, relative to longitudinal cutter axis L. As noted above, under most drilling conditions and even under the widest variation in drilling parameters and cutter back rakes, angle $\alpha$ varies in a range between an $\alpha_1$ of about 20° and an $\alpha_2$ of about 70°. As can readily be seen in FIG. 1, annular surface 20, comprising the aforementioned spherical surface of revolution, lies in an area where forces acting on the cutter 10 are greatest and presents a annular surface orientation facing $F_R$ so that normal vectors to surface 20 are oriented over a range $V_{N1}$ through $V_{N2}$, within which range there is at least one normal vector $V_{NP}$, which is parallel to and coincident with, or only minutely offset from, $F_R$ at any given instant in time. This load-accommodating topography of annular surface 20 thus distributes $F_R$ in an area of substrate end face 14 substantially perpendicular to $F_R$. It is also notable that the area of end face 14 lying within annular surface 20 is configured with annular surface 28 and concave center 30 to provide a substantial superabrasive material depth for table 16 and also an effective mechanical interlock along the interface between table 16 and substrate 12. Moreover, the presence of annular surface 20, dictating an increasing depth of superabrasive material as the table 16 approaches its periphery, generates a beneficial residual (from fabrication) compressive stress concentration in the area of the table periphery where cutter loading is greatest and provides a large volume of superabrasive material in the area of contact with the formation to minimize cutter wear.

Figure 2:
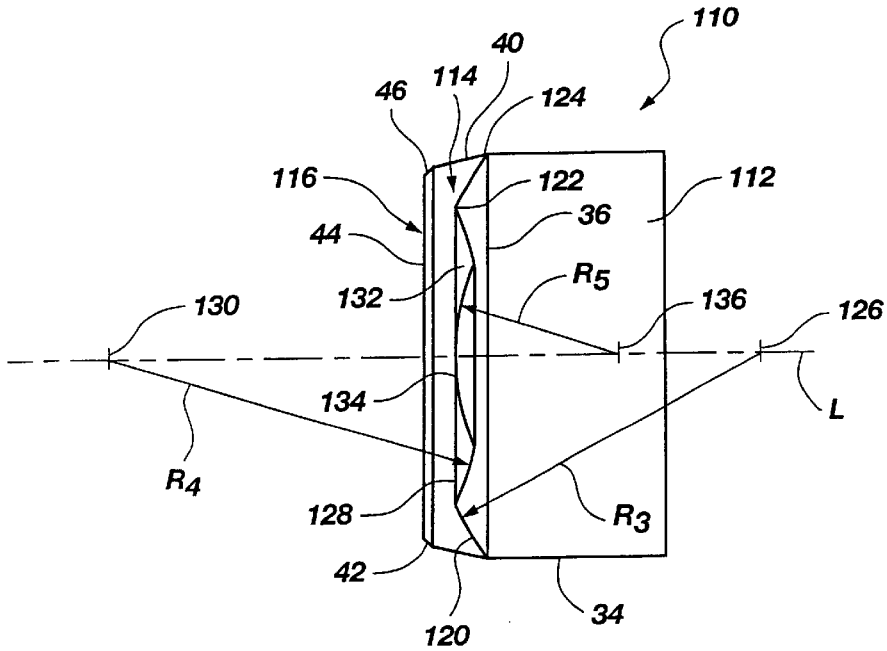
FIG. 2 is a side elevation of a second embodiment of a superabrasive cutter according to the present invention.

Referring to FIG. 2, another embodiment 110 of the cutter of the invention will be described. Features of cutter 10 also incorporated in cutter 110 are identified by the same reference numerals for clarity. Cutter 110 includes a substrate 112 having an end face 114 on which a superabrasive table, such as a polycrystalline diamond compact (PDC) table 116, is formed. Substrate 112 is shown in side elevation with table 116 thereon shown as transparent (rather than in cross-section, with hatching) for clarity in explaining the structure and advantages of the invention in detail, although those of ordinary skill in the art will appreciate that the superabrasive material, such as a PDC, is opaque.

Substrate 112 is substantially cylindrical in shape, of a constant radius about longitudinal axis or centerline L. End face 114 of substrate 112 includes annular surface 120 comprising a spherical surface of revolution of radius $R_3$ having an inner circular periphery 122 and an outer circular periphery 124, the center point of the sphere being located at 126, coincident with longitudinal axis or centerline L. The inner periphery 122 abuts another annular surface 128 comprising a spherical surface of revolution of radius $R_4$. The center point of the sphere being located at 130, coincident with longitudinal axis or centerline L. The inner periphery 132 of annular surface 128 abuts yet another arcuate, spherical surface of revolution 134, of radius $R_5$ about center point 136, coincident with longitudinal axis or centerline L. It should be noted that the uppermost portion of spherical surface of revolution 134 is at the same elevation as inner periphery 122 of annular surface 120, although this is not a requirement of the invention.

Superabrasive table 116 overlies end face 114 and is contiguous therewith, extending to side wall 34 of substrate 112 and defining a linear exterior boundary 36 therewith. Inwardly-tapering frustoconical side wall 40 of table 116 commences adjacent boundary 36 and is of the same radius as substrate 112, extending above boundary 36 to cutting edge 42 at the periphery of cutting face 44. As shown, cutting edge 42 is chamfered at 46 as known in the art, although this is not a requirement of the invention.

As with cutter 10, it will be readily appreciated that annular surface 120 of end face 114 of substrate 112 of cutter 110 will provide a range of normal vectors sufficient to accommodate the range of orientations of resultant force loads acting on cutter 110 proximate cutting edge 42 during a drilling operation and distribute them over an area of end face 114 lying substantially transverse to the loads. Again as with cutter 10, it will be appreciated that a substantial depth of superabrasive material is retained for table 116, and that a mechanically effective, symmetrical interlocking arrangement is provided at the interface between table 116 and substrate 112.

Figure 3A:
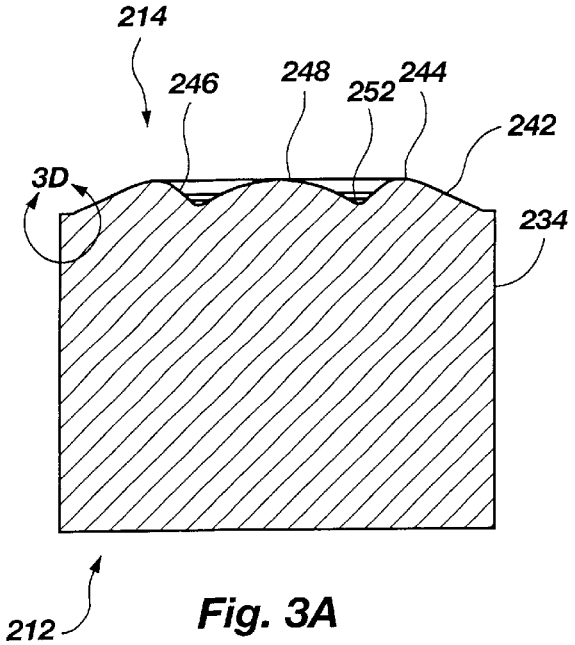
FIG. 3A is a side half-sectional elevation of a supporting substrate having utility in a third embodiment of a superabrasive cutter according to the present invention.
Figure 3B:
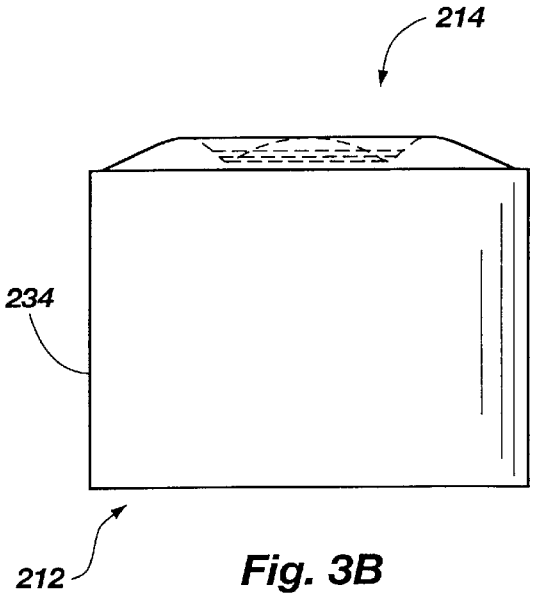
FIG. 3B is a side elevation of the substrate of FIG. 3A.
Figure 3C:
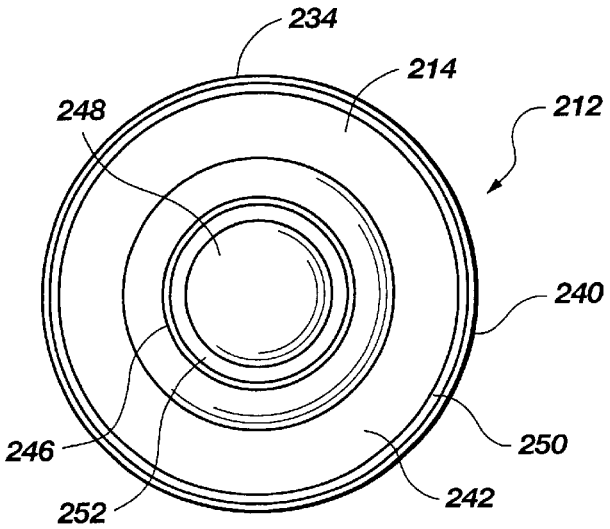
FIG. 3C is a top elevation of the substrate of FIG. 3A.

FIG. 3A shows yet another substrate end face configuration for a cutter according to the present invention in cross-section, while FIG. 3B shows substrate 212 in side elevation and FIG. 3C is a top elevation of end face 214. As with the other embodiments, substrate 212 is substantially cylindrical and includes a number of contiguous, annular surfaces surrounding a circular central surface on end face 214. From the side exterior of substrate 212 inwardly, an annular lip or shoulder 240 extends inwardly from side wall 234, meeting annular surface 242, which comprises a spherical surface of revolution. Annular, arcuate surface 244 lies inwardly of annular surface 242, within which lies arcuate surface 246, within which lies a central surface of revolution 248. Surfaces 242, 244 and 246 are substantially coincident at their mutual boundaries, while the transition between lip 240 and annular surface 242 comprises a small, but measurable, radius 250 (see enlarged detail in FIG. 3D). Similarly, the transition between surface 246 and central surface of revolution 248 comprises a small, but measurable, radius 252.

FIGS. 4 through 16 illustrate a number of other substrate end face configurations according to the invention, it being understood that superabrasive tables such as PDC tables, when formed thereon, will provide cutters according to the invention.

Figure 4:
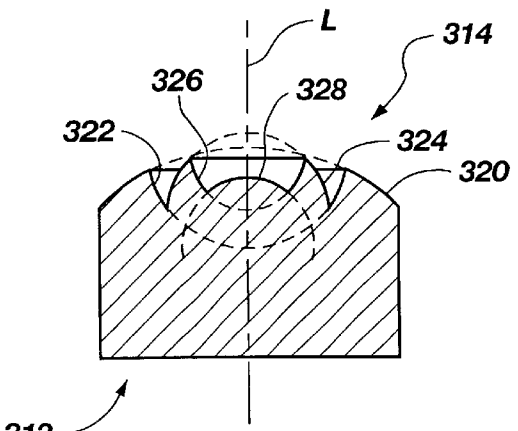
FIGS. 4 through 16 depict, in side sectional elevation, additional embodiments of substrates having utility with superabrasive cutters according to the present invention.
Figure 5:
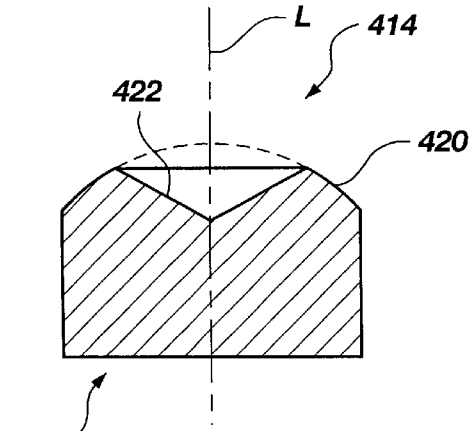

FIG. 4 depicts a side sectional elevation of a substantially cylindrical substrate 312 having an end face 314 comprising a plurality of mutually adjacent spherical surfaces of revolution 320, 322, 324, 326 and 328, the center points of which all lie coincident with the centerline or longitudinal axis L of the substrate 312. In this and subsequent figures, extensions of the actual end face spherical surfaces of revolution in the plane of the paper have been shown in broken lines for a better appreciation of the spherical nature thereof FIG. 5 depicts a side sectional elevation of a substantially cylindrical substrate 412 having an end face 414 comprising a single, outer, spherical, annular surface of revolution 420 surrounding an upward-facing conical surface of revolution 422, the center points of both surfaces of revolution lying on the centerline or longitudinal axis L of the substrate 412.

Figure 6:
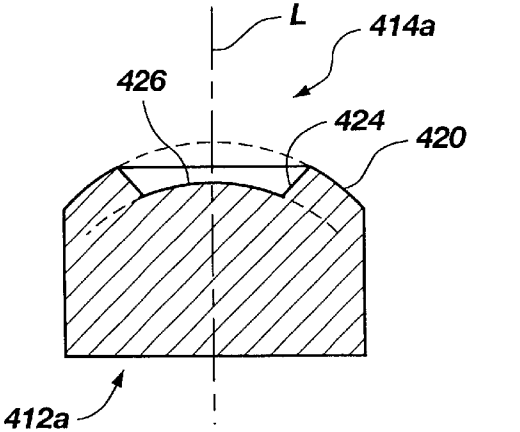

FIG. 6 depicts a side sectional elevation of a substantially cylindrical substrate 412*a* having an end face 414*a* comprising a single, outer, spherical, annular surface of revolution 420 surrounding an upward-facing frustoconical surface of revolution 424, which in turn surrounds a convex, spherical surface of revolution 426. All three surfaces of revolution have center points coincident with the centerline or longitudinal axis L of substrate 412*a*.

Figure 7:
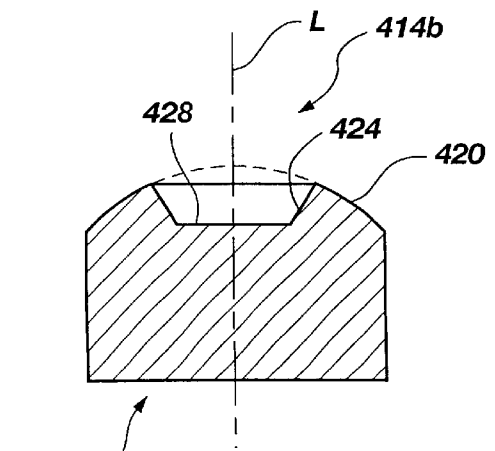

FIG. 7 depicts a side sectional elevation of a substantially cylindrical substrate 412*b* having an end face 414*b* comprising a single, outer, spherical, annular surface of revolution 420 surrounding an upward-facing frustoconical surface of revolution 424, which in turn surrounds a central, circular surface 428. Both surfaces of revolution have center points coincident with the centerline or longitudinal axis L of substrate 412*b*.

Figure 8:
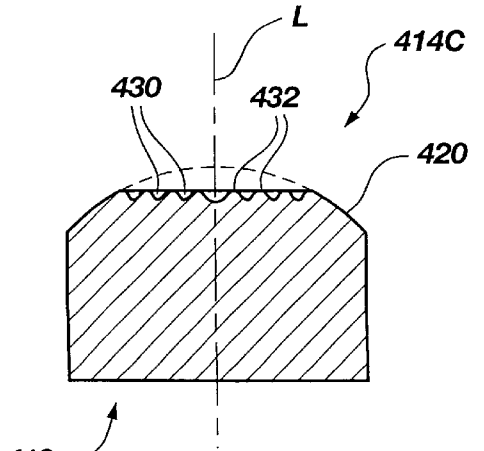

FIG. 8 depicts a side sectional elevation of a substantially cylindrical substrate 412*c* having an end face 414*c* comprising a single, outer, spherical, annular surface of revolution 420 surrounding a plurality of concentric annular grooves 430 having ridges 432 therebetween, the end face features being centered about centerline or longitudinal axis L.

Figure 9:
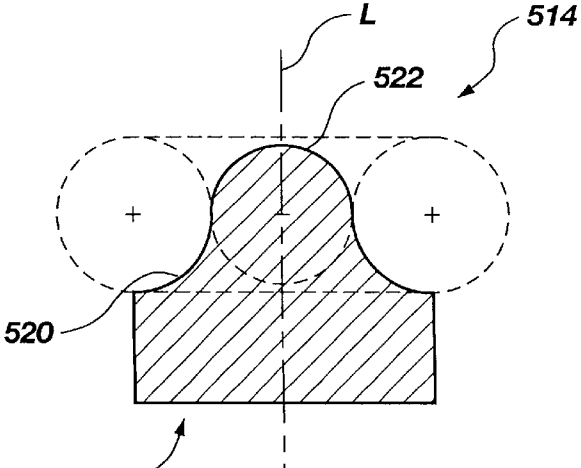

FIG. 9 depicts a side sectional elevation of a substantially cylindrical substrate 512 having an end face 514 comprising a central hemispherical surface 522 contiguous with and surrounded by a concave annular surface 520 comprised of a portion of a toroid of circular cross-section centered about the centerline or longitudinal axis L of substrate 512.

Figure 10:
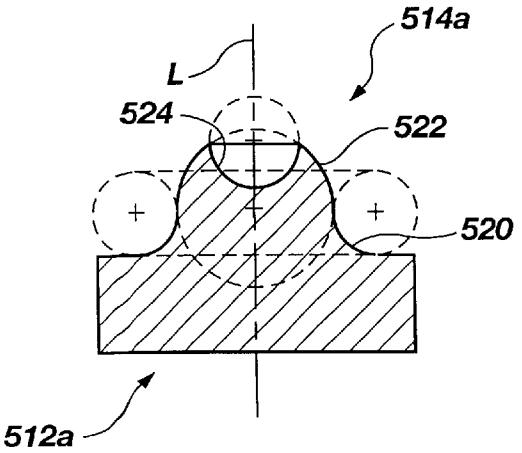
Figure 11:
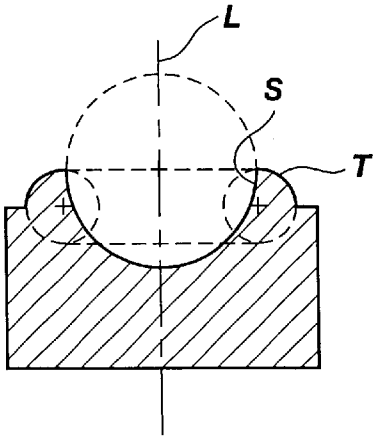
Figure 12:
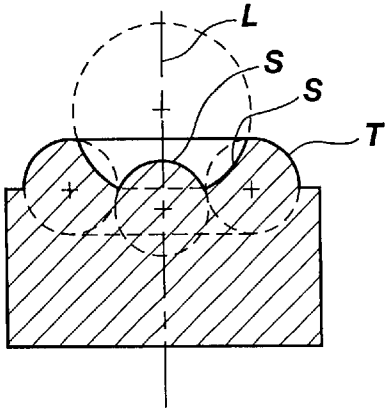
Figure 13:
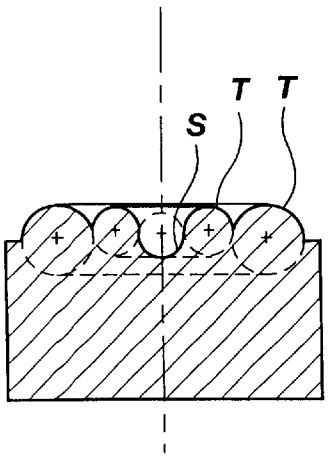
Figure 14:
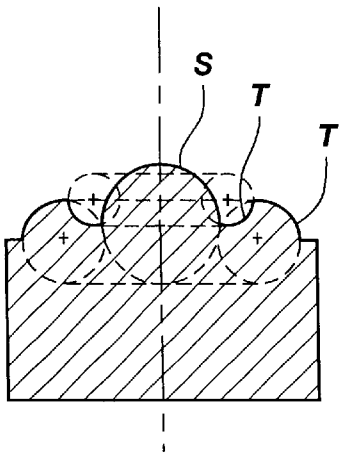
Figure 15:
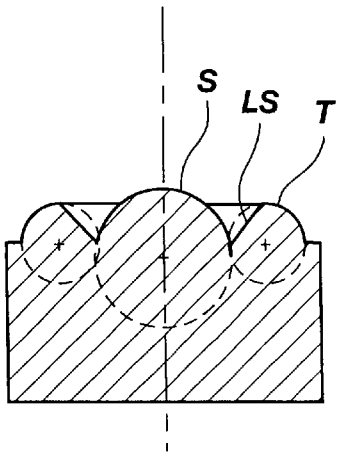

FIG. 10 depicts a side sectional elevation of a substantially cylindrical substrate 512*a* similar to substrate 512, having an end face 514*a* comprising a central hemispherical surface 522 contiguous with and surrounded by an annular surface 520 comprised of a portion of a toroid of circular cross-section. Hemispherical surface 522, however, is intersected by a smaller, spherical surface of revolution 524 defining a central recess or concavity therein.

Other combinations of substrates exhibiting end faces comprised of various combinations of spherical, toroidal and linear surfaces of revolution are depicted in FIGS. 11 through 15. As with the preceding FIGS. 4 through 10, spherical surfaces of revolution and toroids, parts of which comprise substrate surfaces, have been shown, in part in most instances, in broken lines for clarity, as have center points of certain features. Spherical surfaces of revolution have been designated with an "S", toroids with a "T", and linear surfaces of revolution with an "LS".

Figure 16:
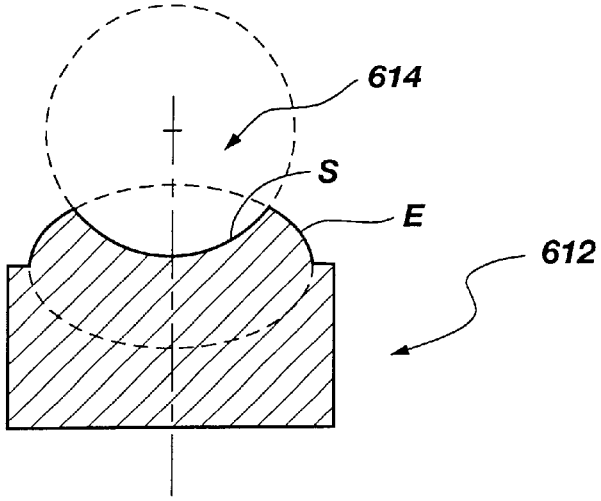

It will also be understood that spherical surfaces of revolution may be replaced, as noted above, by spheroidal surfaces of revolution, as depicted in FIG. 16 showing a substrate 612 having ellipsoidal surface of revolution E on its end face 614. Other non-linear, or arcuate, surfaces of revolution may also be employed, as desired, in a similar or transverse orientation to that shown in FIG. 16.

Figure 17:
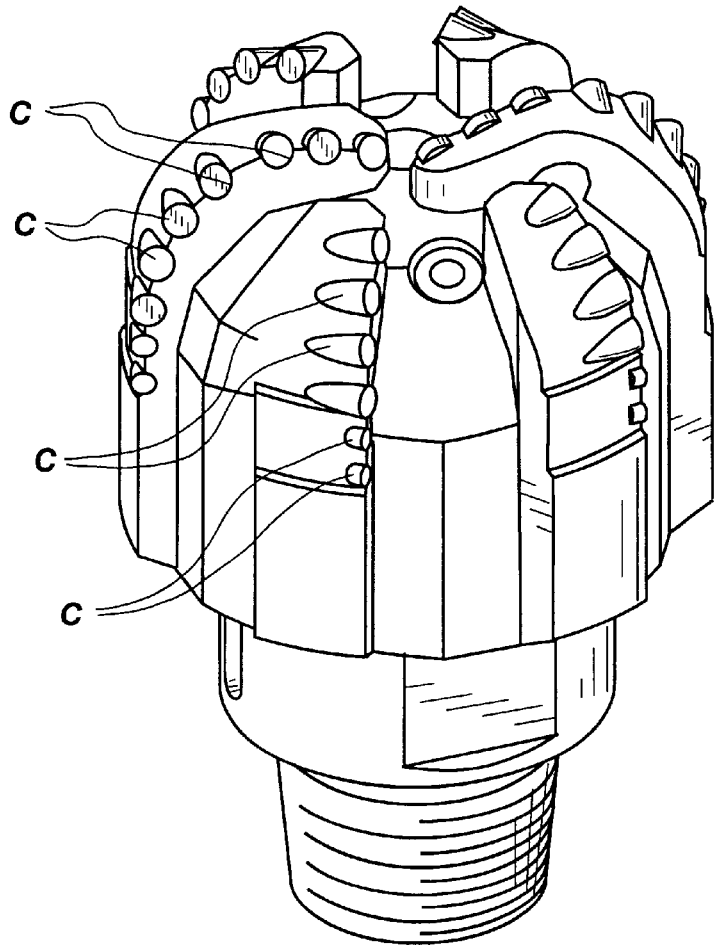
FIG. 17 is a side perspective view of a rotary drag bit equipped with cutters according to the present invention.

FIG. 17 depicts a rotary drag bit equipped with cutters C in accordance with the present invention.

It will be understood that the reference to "annular" surfaces herein is not limited to surfaces defining a complete annulus or ring. For example, a partial annulus in the area of the substrate end face oriented to accommodate resultant loading on the cutting edge is contemplated as included in the present invention. Similarly, a discontinuous or segmented annular surface is likewise included. Moreover, an "arcuate" surface topography includes surfaces which curve on a constant radius, such as spherical surfaces of revolution and toroids of circular cross-section as well as spheroidal surfaces as those which include components from, for example, two distinct radii about center points, and further include surfaces which are non-linear but curve on varying or continuously or intermittently variable radii.

While the present invention has been disclosed in terms of certain exemplary embodiments, those of ordinary skill in the art will understand and appreciate that it is not so limited. Many additions, deletions and modifications to the invention as disclosed herein may be effected, as well as combinations of features from the various disclosed embodiments, without departing from the scope of the invention as defined by the claims.

What is claimed is:

1. A cutter for drilling a subterranean formation, comprising:

a substrate having a longitudinal centerline and a substantially circular end face, the end face comprising, as taken in radial cross-section longitudinally parallel to the longitudinal centerline a non-sinusoidal, non-periodically repeating topographic configuration including at least one annular surface exhibiting an arcuate shape defined by at least a portion of a surface of revolution of a radius about a center point and exhibiting a unique size and shape in comparison to the size and shape of any other surface of the end face; and a volume of superabrasive material disposed over the end face and having a two-dimensional cutting face spaced from the substrate end face, the cutting face having a peripheral cutting edge wherein the at least one annular surface comprises a spherical surface of revolution including a center point coincident with the centerline.

2. The cutter of claim 1, wherein the at least one annular surface has a radially inner periphery, and the cutting edge is arcuate and of a radius from the centerline the same or greater than the radially inner periphery of the at least one annular surface.

3. The cutter of claim 2, wherein the at least one annular surface has a radially outer periphery, and the cutting edge lies radially inwardly from the radially outer periphery.

4. The cutter of claim 1, wherein the at least one annular surface comprises a spheroidal surface of revolution.

5. The cutter of claim 1, wherein the at least one annular surface comprises a partial surface of a toroid centered about and transverse to the longitudinal centerline.

6. The cutter of claim 5, wherein the partial surface of the toroid is concave.

7. The cutter of claim 5, wherein the partial surface of the toroid is convex.

8. The cutter of claim 1, wherein the at least one annular surface has radially outer periphery, at least a portion of which is coincident with an outer periphery of the end face.

9. The cutter of claim 1, wherein the at least one annular surface has a radially outer periphery, at least a portion of which is spaced from an outer periphery of the end face.

10. The cutter of claim 1, wherein the at least one annular surface has a radially inner periphery, within which lies a recess.

11. The cutter of claim 10, wherein the recess comprises at least one spherical surface of revolution having a center point coincident with the centerline.

12. The cutter of claim 11, wherein the at least one spherical surface of revolution intersects the centerline.

13. The cutter of claim 12, further including a second annular surface interposed between the at least one annular surface and the at least one spherical surface of revolution.

14. The cutter of claim 13, wherein the second annular surface is flat and lies transverse to the longitudinal centerline.

15. The cutter of claim 13, wherein the recess comprises at least another spherical surface of revolution having a center point coincident with the longitudinal centerline defining the second annular surface.

16. The cutter of claim 13, wherein the recess comprises the second annular surface.

17. The cutter of claim 16, wherein the second annular surface is of arcuate radial cross-section, taken parallel to the longitudinal centerline.

18. The cutter of claim 14, wherein the second annular surface comprises a partial surface of a toroid centered about and transverse to the longitudinal centerline.

19. The cutter of claim 10, wherein the recess comprises a conical surface.

20. The cutter of claim 10, wherein the recess comprises a circular surface.

21. The cutter of claim 20, wherein the circular surface comprises a plurality of concentric grooves.

22. The cutter of claim 1, wherein the at least one annular surface comprises a partial surface of a toroid centered about and transverse to the centerline, and the end face further includes a spherical surface of revolution having a center point coincident with the longitudinal centerline.

23. The cutter of claim 22, wherein the spherical surface of revolution extends across the longitudinal cenetrline.

24. The cutter of claim 1, wherein the at least one annular surface comprises a plurality of concentric annular surfaces, each comprising a partial surface of a toroid centered about and transverse to the longitudinal centerline.

25. The cutter of claim 24, wherein the respective toroids of the plurality of concentric annular surfaces are of circular radial cross-section, the centers of which are on a common radius transverse to the longitudinal centerline.

26. The cutter of claim 25, wherein the radii of the cross-sections of the respective toroids are the same.

27. A cutter for drilling a subterranean formation, comprising:

a substrate having a longitudinal centerline and a substantially circular end face comprising, taken in radial cross-section longitudinally parallel to the longitudinal centerline, at least one annular surface exhibiting an arcuate shape defined by at least a portion of a surface of revolution of a radius about a center point and exhibiting a unique size and shape in comparison to the size and shape of any other surface of the end face, the at least one annular surface including a radially inner periphery within which lies a recess; and a volume of superabrasive material disposed over the end face and having a two-dimensional cutting face spaced from the substrate end face, the cutting face having a peripheral cutting edge wherein the recess comprises a frustoconical surface encompassing a circular surface.

28. The cutter of claim 27, wherein the circular surface is flat and transverse to the longitudinal centerline.

29. The cutter of claim 27, wherein the circular surface comprises a plurality of concentric grooves.

30. A cutter for drilling a subterranean formation, comprising:

a substrate having a longitudinal centerline and a substantially circular end face, the end face comprising, as taken in radial cross-section longitudinally parallel to the centerline, a non-sinusoidal, non-periodically repeating topogaphic configuration including at least one annular surface exhibiting an arcuate shape defined by at least a portion of a surface of revolution of a radius about a center point and exhibiting a unique size and shape in comparison to the size and shape of any other surface of the end face; and a volume of superabrasive material disposed over the end face and having a two-dimensional cutting face spaced from the substrate end face, the cutting face having a peripheral cutting edge wherein the at least one annular surface comprises a spherical surface of revolution having a center point coincident with the centerline and the end face further includes a second spherical surface of revolution having a smaller radius than the spherical surface of revolution and the same center point.

31. A cutter for drilling a subterranean formation, comprising:

a substrate having a longitudinal centerline and a substantially circular end face comprising, taken in radial cross-section longitudinally parallel to the longitudinal centerline, at least one annular surface exhibiting an arcuate shape defined by at least a portion of a surface of revolution of a radius about a center point and exhibiting a unique size and shape in comparison to the size and shape of any other surface of the end face, at least one second annular surface including a partial surface of a toroid centered about and transverse to the centerline and the end face including a spherical surface of revolution extending over the centerline and having a center point coincident with the centerline, the spherical surface of revolution further being tangentially coincident at a radially outer periphery with a radially inner periphery of the partial surface of the toroid; and a volume of superabrasive material disposed over the end face and having a two-dimensional cutting face spaced from the substrate end face, the cutting face having a peripheral cutting edge.

32. A cutter for drilling a subterranean formation, comprising:

a substrate having a longitudinal centerline and an end face comprising, taken in radial cross-section longitudinally parallel to the longitudinal centerline, at least one annular surface exhibiting an arcuate shape defined by at least a portion of a surface of revolution of a radius about a center point and exhibiting a unique size and shape in comparison to the size of any other surfaces of the end face, the at least one annular surface including a partial surface of a toroid centered about and transverse to the longitudinal centerline, and the end face including a spherical surface of revolution having a center point coincident with the centerline; and a volume of superabrasive material disposed over the end face and having a two-dimensional cutting face spaced from the substrate end face, the cutting face having a peripheral cutting edge wherein the spherical surface of revolution extends across the centerline.

33. A cutter for drilling a subterranean formation, comprising:

a substrate having a longitudinal centerline and a substantially circular end face comprising, taken in radial cross-section longitudinally parallel to the longitudinal centerline, at least one annular surface exhibiting an arcuate shape defined by at least a portion of a surface of revolution of a radius about a center point and exhibiting a unique size and shape in comparison to the size of any other surface of the end face, at least one second annular surface, the at least one second annular surface including a plurality of concentric annular surfaces, each comprising a partial surface of a toroid centered about and transverse to the centerline, the toroids being of a circular radial cross-section, and which centers of the toroids lie on longitudinally offset radii transverse to the centerline; and a volume of superabrasive material disposed over the end face and having a two-dimensional cutting face spaced from the substrate end face, the cutting face having a peripheral cutting edge.

34. A drill bit for drilling a subterranean formation, comprising:

a bit body having a face at one end thereof and structure at an opposing end thereof for connecting the bit to a drill string; and at least one cutter mounted to the bit body over the bit face and comprising:

a substrate having a longitudinal centerline and a substantially circular end face comprising, taken in radial cross-section longitudinally parallel to the longitudinal centerline, at least one first annular surface exhibiting an arcuate shape, the at least one first annular surface including a radially inner periphery within which lies a recess, the recess including at least one spherical surface of revolution intersecting the centerline and having a center point coincident with the centerline, and at least one second annular surface exhibiting a generally flat shape interposed between the at least one first annular surface and the at least one spherical surface of revolution and which lies transverse to the centerline, and the at least one second annular surface comprising a frustoconical surface; and a volume of superabrasive material disposed over the end face and having a two-dimensional cutting face spaced from the substrate end face, the cutting face having a peripheral cutting edge.

35. A drill bit for drilling a subterranean formation, comprising:

a bit body having a face at one end thereof and structure at an opposing end thereof for connecting the bit to a drill string; and at least one cutter mounted to the bit body over the bit face and comprising:

a substrate having a longitudinal centerline and a substantially circular end face comprising, taken in radial cross-section longitudinally parallel to the longitudinal centerline, at least one annular surface exhibiting an arcuate shape, the at least one annular surface including a radially inner periphery within which lies a recess comprising a frustoconical surface; and a volume of superabrasive material disposed over the end face and having a two-dimensional cutting face spaced from the substrate end face, the cutting face having a peripheral cutting edge.

36. The drill bit of claim 35, wherein the frustoconical surface encompasses a circular surface.

37. The drill bit of claim 36, wherein the circular surface is flat and transverse to the longitudinal centerline.

38. The drill bit of claim 36, wherein the circular surface comprises a plurality of concentric grooves.

39. A drill bit for drilling a subterranean formation, comprising:

a bit body having a face at one end thereof and structure at an opposing end thereof for connecting the bit to a drill string; and at least one cutter mounted to the bit body over the bit face and comprising:

a substrate having a longitudinal centerline and a substantially circular end face, the end face comprising, as taken in radial cross-section longitudinally parallel to the centerline, a non-sinusoidal, non-periodically repeating topographic configuration including at least one annular surface exhibiting an arcuate shape defined by at least a portion of a surface of revolution of a radius about a center point and exhibiting a unique size and shape in comparison to the size and shape of any other surface of the end face; and a volume of superabrasive material disposed over the end face and having a two-dimensional cutting face spaced from the substrate end face, the cutting face having a peripheral cutting edge wherein the at least one annular surface comprises a spherical surface of revolution having a center point coincident with the centerline and the end face further includes a second spherical surface of revolution having a smaller radius than the spherical surface of revolution and the same center point.

40. A drill bit for drilling a subterranean formation, comprising:

a bit body having a face at one end thereof and structure at an opposing end thereof for connecting the bit to a drill string; and at least one cutter mounted to the bit body over the bit face and comprising:

a substrate having a longitudinal centerline and a substantially circular end face comprising, taken in radial cross-section longitudinally parallel to the longitudinal centerline, at least one annular surface exhibiting an arcuate shape defined by at least a portion of a surface of revolution of a radius about a center point and exhibiting a unique size and shape in comparison to the size and shape of any other surface of the end face, the at least one annular surface including a partial surface of a toroid centered about and transverse to the centerline, and the end face including a spherical surface of revolution extending across the centerline and having a center point coincident with the centerline, and the spherical surface of revolution being tangentially coincident at a radially outer periphery with a radially inner periphery of the partial surface of the toroid; and a volume of superabrasive material disposed over the end face and having a two-dimensional cutting face spaced from the substrate end face, the cutting face having a peripheral cutting edge.

41. A drill bit for drilling a subterranean formation, comprising:

a bit body having a face at one end thereof and structure at an opposing end thereof for connecting the bit to a drill string; and at least one cutter mounted to the bit body over the bit face and comprising:

a substrate having a longitudinal centerline and a substantially circular end face comprising, taken in radial cross-section longitudinally parallel to the longitudinal centerline, at least one annular surface exhibiting an arcuate shape, the at least one annular surface including a partial surface of a toroid centered about and transverse to the centerline, the end face including a spherical surface of revolution having a center point coincident with the centerline, and the end face having a second spherical surface of revolution having a center point coincident with the centerline and having a radius smaller than that of the spherical surface of revolution; and a volume of superabrasive material disposed over the end face and having a two-dimensional cutting face spaced from the substrate end face, the cutting face having a peripheral cutting edge.

42. The drill bit of claim 41, wherein the second spherical surface of revolution extends across the longitudinal centerline.

43. A drill bit for drilling a subterranean formation, comprising:

a bit body having a face at one end thereof and structure at an opposing end thereof for connecting the bit to a drill string; and at least one cutter mounted to the bit body over the bit face and comprising:

a substrate having a longitudinal centerline and a substantially circular end face comprising, taken in radial cross-section longitudinally parallel to the longitudinal centerline, at least one annular surface exhibiting an arcuate shape, the at least one annular surface including a partial surface of a toroid centered about and transverse to the centerline, the end face including a spherical surface of revolution extending across the centerline and having a center point coincident with the centerline, and a frustoconical surface interposed between the partial surface of the toroid and the spherical surface of revolution; and a volume of superabrasive material disposed over the end face and having a two-dimensional cutting face spaced from the substrate end face, the cutting face having a peripheral cutting edge.

44. A drill bit for drilling a subterranean formation, comprising:

a bit body having a face at one end thereof and structure at an opposing end thereof for connecting the bit to a drill string; and at least one cutter mounted to the bit body over the bit face and comprising:

a substrate having a longitudinal centerline and a substantially circular end face comprising, taken in radial cross-section longitudinally parallel to the longitudinal centerline, at least one annular surface exhibiting an arcuate shape defined by at least a portion of a surface of revolution of a radius about a center point and exhibiting a unique size and shape in comparison to the size of any other surface of the end face, at least one second annular surface comprising a plurality of concentric annular surfaces, each concentric annular surface comprising a partial surface of a toroid centered about and transverse to the centerline, and the toroids being of a circular cross-section, the centers of which lie on longitudinally offset radii transverse to the centerline; and a volume of superabrasive material disposed over the end face and having a two-dimensional cutting face spaced from the substrate end face, the cutting face having a peripheral cutting edge.

45. A cutter for drilling a subterranean formation, comprising:

a substrate having a longitudinal centerline, a side wall radially distanced from the centerline, and a substantially circular end face, the end face comprising, as taken in radial cross-sectional longitudinally parallel to the centerline: a non-sinusoidal, non periodically repeating topographic configuration including a first annular surface exhibiting a convex shape defined by a spherical surface of revolution having a center point coincident to the longitudinal centerline, a second annular surface exhibiting a concave, partial surface of a first toroid centered about and transverse to the centerline, a third annular surface exhibiting a convex, partial surface of a second toroid centered about and transverse to the longitudinal centerline, and an annular ledge extending inwardly from the side wall toward the longitudinal centerline; and a volume of superabrasive material disposed over the end face and having a two-dimensional cutting face spaced from the substrate end face, the cutting face having a peripheral cutting edge.

46. The cutter of claim 45, wherein the second annular surface is radially interposed between the first annular surface and the third annular surface and the third annular surface is radially interposed between the second annular surface and the annular ledge.

47. The cutter of claim 46, wherein the first annular surface is contiguous with the second annular surface, the second annular surface is contiguous with the third annular surface, and the third annular surface is contiguous with the annular ledge.

48. The cutter of claim 47, wherein the annular ledge is generally planar.

49. The cutter of claim 47, wherein the first and second toroids are of generally circular cross-section having respective centers and respective radii.

50. The cutter of claim 49, wherein the radii of the first and second toroids are dimensionally different.

51. The cutter of claim 50, wherein the centers of the first and second toroids lie are longitudinally and radially offset from each other with respect to the longitudinal centerline.

52. The cutter of claim 47, wherein each of the first, second, and third annular surfaces do not extend beyond a preselected maximum longitudinal elevation and the annular ledge is positioned below the preselected maximum longitudinal elevation.

53. The cutter of claim 45, wherein the peripheral cutting edge of the cutting face is of a radius from the longitudinal centerline the same or lesser than the radial distance of the side wall of the substrate.

54. A drill bit for drilling a subterranean formation, comprising:

a bit body having a face at one end thereof and structure at an opposing end thereof for connecting the bit body to a drill string; and at least one cutter mounted to the bit body over the bit face and comprising:

a substrate having a longitudinal centerline, a side wall radially distanced from the centerline, and a substantially circular end face, the end face comprising, as taken in radial cross-sectional longitudinally parallel to the centerline, a non-sinusoidal, non-periodically repeating topographic configuration including a first annular surface exhibiting a convex shape defined by a spherical surface of revolution having a center point coincident to the longitudinal centerline, a second annular surface exhibiting a concave, partial surface of a first toroid centered about and transverse to the centerline, a third annular surface exhibiting a convex, partial surface of a second toroid centered about and transverse to the longitudinal centerline, and an annular ledge extending inwardly from the side wall toward the longitudinal centerline; and a volume of superabrasive material disposed over the end face and having a two-dimensional cutting face spaced from the substrate end face, the cutting face having a peripheral cutting edge.

55. The drill bit of claim 54, wherein the second annular surface is radially interposed between the first annular surface and the third annular surface and the third annular surface is radially interposed between the second annular surface and the annular ledge.

56. The drill bit of claim 55, wherein the first annular surface is contiguous with the second annular surface, the second annular surface is contiguous with the third annular surface, and the third annular surface is contiguous with the annular ledge.

57. The drill bit of claim 56, wherein the annular ledge is generally planar.

58. The drill bit of claim 56, wherein the first and second toroids are of generally circular cross-section having respective centers and respective radii.

59. The drill bit of claim 58, wherein the radii of the first and second toroids are dimensionally different.

60. The drill bit of claim 59, wherein the centers of the first and second toroids lie are longitudinally and radially offset from each other with respect to the longitudinal centerline.

61. The drill bit of claim 56, wherein each of the first, second, and third annular surfaces do not extend beyond a preselected maximum longitudinal elevation and the annular ledge is positioned below the preselected maximum longitudinal elevation.

62. The drill bit of claim 54, wherein the peripheral cutting edge of the cutting face is of a radius from the centerline the same or lesser than the radial distance of the side wall of the substrate.

63. A cutter for drilling a subterranean formation, comprising:

a substrate having a longitudinal centerline and a substantially circular end face, the end face comprising, as taken in radial cross-section longitudinally parallel to the centerline, a non-sinusoidal, non-periodically repeating topographic configuration including at least one annular surface exhibiting an arcuate shape and comprising a spherical surface of revolution having a center point coincident with the centerline and the end face further including a second spherical surface of revolution having a smaller radius than the spherical surface of revolution and the same center point; and a volume of superabrasive material disposed over the end face and having a two-dimensional cutting face spaced from the substrate end face, the cutting face having a peripheral cutting edge.

64. A drill bit for drilling a subterranean formation, comprising:

a bit body having a face at one thereof and structure at an opposing thereof for connecting the bit to a drill string;

at least one cutter mounted to the bit body over the bit face and comprising:

a substrate having a longitudinal centerline and a substantially circular end face, the end face comprising, as taken in radial cross-section longitudinally parallel to the centerline, a non-sinusoidal, non-periodically repeating topographic configuration including at least one annular surface exhibiting an arcuate shape and comprising a spherical surface of revolution having a center point coincident with the centerline and the end face further including a second spherical surface of revolution having a smaller radius than the spherical surface of revolution and the same center point; and a volume of superabrasive material disposed over the end face and having a two-dimensional cutting face spaced from the substrate end face, the cutting face having a peripheral cutting edge.

* * * * *

UNITED STATES PATENT AND TRADEMARK OFFICE

CERTIFICATE OF CORRECTION

Figure 3D:
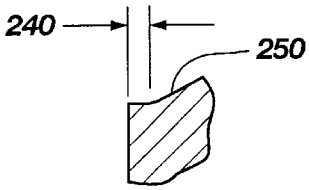
FIG. 3D is an enlarged cross-sectional detail of area D in FIG. 3A.

PATENT NO. : 6,412,580 B1
APPLICATION NO. : 09/104620
DATED : July 2, 2002
INVENTOR(S) : Arthur A. Chaves It is certified that error appears in the above-identified patent and that said Letters Patent is hereby corrected as shown below:

In the drawings:

| | | |
|---|---|---|
| FIG. 3D | | change “250” to --240-- and change “240” to --250-- |

In the specification:

| | | |
|---|---|---|
| COLUMN 5, | LINE 66, | change the period after “$R_4$” to a comma |
| COLUMN 5, | LINE 67, | at the beginning of the line, change “The” to --the-- |
| COLUMN 6, | LINE 64, | insert a period after “thereof” |

In the claims:

| | | |
|---|---|---|
| CLAIM 8, COLUMN 8, | LINE 52, | change “has radially outer” to --has a radially outer-- |
| CLAIM 51, COLUMN 14, | LINE 36, | change “toroids lie are longitudinally and radially offset” to --toroids are longitudinally and radially offset-- |
| CLAIM 60, COLUMN 15, | LINE 25, | change “toroids lie are longitudinally and radially offset” to --toroids are longitudinally and are radially offset-- |

UNITED STATES PATENT AND TRADEMARK OFFICE

CERTIFICATE OF CORRECTION

PATENT NO. : 6,412,580 B1
APPLICATION NO. : 09/104620
DATED : July 2, 2002
INVENTOR(S) : Arthur A. Chaves It is certified that error appears in the above-identified patent and that said Letters Patent is hereby corrected as shown below:

Please replace FIG. 3D with the following amended drawing:

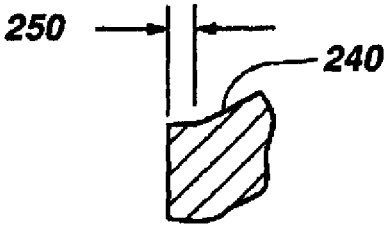

*Fig. 3D*

Signed and Sealed this

Fifth Day of May, 2009

John Doll

JOHN DOLL
*Acting Director of the United States Patent and Trademark Office*